US007953600B2

(12) United States Patent
Hertz et al.

(10) Patent No.: US 7,953,600 B2
(45) Date of Patent: May 31, 2011

(54) SYSTEM AND METHOD FOR HYBRID SPEECH SYNTHESIS

(75) Inventors: Susan R. Hertz, Ithaca, NY (US); Harold G. Mills, Ithaca, NY (US)

(73) Assignee: NovaSpeech LLC, Ithaca, NY (US)

( * ) Notice: Subject to any disclaimer, the term of this patent is extended or adjusted under 35 U.S.C. 154(b) by 1040 days.

(21) Appl. No.: 11/739,452

(22) Filed: Apr. 24, 2007

(65) Prior Publication Data

US 2008/0270140 A1 Oct. 30, 2008

(51) Int. Cl.
*G10L 13/00* (2006.01)

(52) U.S. Cl. ..... 704/258; 704/269

(58) Field of Classification Search ..... None
See application file for complete search history.

(56) References Cited

U.S. PATENT DOCUMENTS

| | | | | |
|---|---|---|---|---|
| 5,704,007 | A * | 12/1997 | Cecys | 704/260 |
| 5,864,812 | A | 1/1999 | Kamai et al. | |
| 6,112,178 | A * | 8/2000 | Kaja | 704/267 |
| 6,175,821 | B1 * | 1/2001 | Page et al. | 704/258 |
| 6,308,156 | B1 | 10/2001 | Barry et al. | |
| 6,535,852 | B2 * | 3/2003 | Eide | 704/260 |
| 7,139,712 | B1 * | 11/2006 | Yamada | 704/266 |
| 7,249,021 | B2 * | 7/2007 | Morio et al. | 704/258 |
| 7,369,995 | B2 * | 5/2008 | Ferencz et al. | 704/260 |
| 7,451,087 | B2 * | 11/2008 | Case et al. | 704/267 |
| 7,716,052 | B2 * | 5/2010 | Aaron et al. | 704/258 |
| 2005/0256716 | A1 * | 11/2005 | Bangalore et al. | 704/260 |

FOREIGN PATENT DOCUMENTS

| | | |
|---|---|---|
| GB | 2 392 592 A | 3/2004 |
| JP | 07152396 A | 6/1995 |

OTHER PUBLICATIONS

Fries, Georg, "Hybrid Time- and Frequency-Domain Speech Synthesis With Extended Glottal Source Generation," Deutsche Bundespost Telekom, 1994, pp. I-581 to I-584.

Fries, Georg, "Phoneme-Dependent Speech Synthesis in the Time and Frequency Domains," Deutsche Bundespost Telekom, ISCA Archive, http://www.isca-speech.org, 3rd European Conference on Speech Communication and Technology EUROSPEECH'93, Berlin, Germany, Sep. 19-23, 1993, pp. 921-924.

(Continued)

*Primary Examiner* — Brian L Albertalli
(74) *Attorney, Agent, or Firm* — Cesari and McKenna, LLP

(57) ABSTRACT

A speech synthesis system receives symbolic input describing an utterance to be synthesized. In one embodiment, different portions of the utterance are constructed from different sources, one of which is a speech corpus recorded from a human speaker whose voice is to be modeled. The other sources may include other human speech corpora or speech produced using Rule-Based Speech Synthesis (RBSS). At least some portions of the utterance may be constructed by modifying prototype speech units to produce adapted speech units that are contextually appropriate for the utterance. The system concatenates the adapted speech units with the other speech units to produce a speech waveform. In another embodiment, a speech unit of a speech corpus recorded from a human speaker lacks transitions at one or both of its edges. A transition is synthesized using RBSS and concatenated with the speech unit in producing a speech waveform for the utterance.

58 Claims, 11 Drawing Sheets

OTHER PUBLICATIONS

Hertz, Susan R. et al., "Language-Universal and Language-Specific Components in the Multi-Language ETI-Eloquence Test-To-Speech System," 14th Int. Cong. Phonet. Sciences, San Francisco, CA, Aug. 1999, pp. 2283-2286.
Ohlin, David and Rolf Carlson, "Data-driven Formant Synthesis," CTT, Department of Speech Music and Hearing, KTH, Proceedings, FONETIK 2004, Dep. Of Linguistics, Stockholm University, 2004. pp. 1-4.
Pearson, Steve et al., "Combining Concatenation and Formant Synthesis for Improved Intelligibility and Naturalness in Text-To-Speech Systems," International Journal of Speech Technology, Kluwer Academic Publishers, 1997, pp. 103-107.
Wouters, Johan and Michael W. Macon, "Unit Fusion for Concatenative Speech Synthesis," Center for Spoken Language Understanding, Oregon Graduate Institute, http://cslu.cse.ogi.edu, 2000, pp. 1-4.
Hertz, Susan R., "A Model of the Regularities Underlying Speaker Variation: Evidence from Hybrid Synthesis", NovaSpeech LLC and Cornell University, Ithaca, NY, Proc. InterSpeech 2006, 4 pages.
Hertz, Susan R., "Streams, phones and transitions: toward a new phonological and phonetic model of formant timing", 1991 Academic Press Limited, Journal of Phonetics (1991), pp. 91-109.
Benzmuller, et al., "Microsegment Synthesis—Economic principles in a low-cost solution", Spoken Language, 1996. ICSLP 96. Proceedings., Fourth International Conference on vol. 4, Issue , Oct. 3-6, 1996 pp. 2383-2386 vol. 4.
Klatt, et al., "Analysis, Synthesis, and perceptionof voice quality variations among femaile and male talkers", Acoustical Society of America, Feb. 1990, pp. 820-857.
Hertz, Susan R., "Integration of Rule-Based Formant Synthesis and Waveform Concatenation: A Hybrid Approach to Text-to-Speech Synthesis", Proceedings IEEE 2002 Workshop on Speech Synthesis, Santa Monica, CA, 5 pages.
Hertz, Susan R. et al., "When Can Segments Serve as Surrogates?", NovaSpeech LLC and Cornell University, 1 page.
Hertz, Susan R. et al., "Perceptual Consequences of Nasal Surrogates in English: Implications for Speech Synthesis", NovaSpeech LLC and Cornell University, 1 page.
Heid, et al., "Procsy: A Hybrid Approach to High-Quality Formant Synthesis Using HLSYN", May 1999, pp. 1-24.
Hunt, et al., "Unit Selection in a Concatenative Speech Synthesis System Using a Large Speech Database", Acoustics, Speech, and Signal Processing, 1996. ICASSP-96. Conference Proceedings., 1996 IEEE International Conference on vol. 1, Issue , May 7-10, 1996 pp. 373-376 vol. 1.
Hertz, et al., "A Nucleus-Based Timing Model Applied to Multi-Dialect Speech Synthesis," 2nd International Conference on Spoken Language Processing (ICSLP 1992), Alberta, Canada, Oct. 1992, pp. 1171-1174.
Hertz, Susan R., "Integration of Rule-Based Formant Synthesis and Wavefrom Concatenation: A Hybrid Approach to Text-To-Speech Synthesis," SpeechWorks International, Inc. and Department of Linguistics at Cornell University, XP010653618, Proceedings of 2002 IEEE Workshop on Sep. 11-13, 2002, Sep. 11, 2002, pp. 87-90.
Hertz, Susan R. et al., "Language-Universal and Language-Specific Components in the Multi-Language Eti-Eloquence Text-To-Speech System," Eloquent Technology, Inc. and Department of Linguistics at Cornell University, XP002486021, Proceedings 14th International Congress Phonetic Sciences, Aug. 1999, pp. 2283-2286.
Hertz, Susan R., "A Model of the Regularities Underlying Speaker Variation: Evidence from Hybrid Synthesis," NovaSpeech LLC and Cornell University, XP001538178, Proceedings of the Interspeech (ICSLP), Sep. 17-21, 2006, pp. 1249-1252.
"Notification of Transmittal of the International Search Report and the Written Opinion of the International Searching Authority, or the Declaration," International Filing Date: Apr. 4, 2008, International Application No. PCT/US2008/004767, Applicant: NOVASPEECH LLC, Date of Mailing: Jul. 15, 2008, pp. 1-15.

* cited by examiner

300

| V | Ṽ | Vn | V | Vŋ | Vl | Ṽl | Vln | Vlm | Vr | Ṽr | Vrn | Vrm | Vrl | Ṽrl |
|---|---|---|---|---|---|---|---|---|---|---|---|---|---|---|
| i | ĩ | in | im | | il | ĩl | | | | | | | | |
| ɪ | ɪ̃ | ɪn | ɪm | ɪŋ | ɪl | ɪ̃l | ɪln | ɪlm | ɪr | ɪ̃r | | | | |
| e | ẽ | en | em | | el | ẽl | | | | | | | | |
| ɛ | ɛ̃ | ɛn | ɛm | ɛŋ | ɛl | ɛ̃l | | ɛlm | ɛr | ɛ̃r | | | ɛrl | ɛ̃rl |
| æ | æ̃ | æn | æm | æŋ | æl | æ̃l | | | | | | | | |
| ʌ | ʌ̃ | ʌn | ʌm | ʌŋ | ʌl | ʌ̃l | | | | | | | | |
| ɚ | ɚ̃ | ɚn | ɚm | | ɚl | ɚ̃l | | | | | | | | |
| a | ã | an | am | aŋ | al | ãl | | | ar | ãr | arn | arm | arl | ãrl |
| u | ũ | un | um | | ul | ũl | | | | | | | | |
| ʊ | ʊ̃ | ʊn | ʊm | ʊŋ | ʊl | ʊ̃l | | | ʊr | ʊ̃r | | | ʊrl | |
| o | õ | on | om | | ol | õl | | | | | | | | |
| ɔ | ɔ̃ | ɔn | ɔm | ɔŋ | ɔl | ɔ̃l | | | ɔr | ɔ̃r | ɔrn | ɔrm | ɔrl | ɔ̃rl |
| ay | ãy | ayn | aym | | ayl | ãyl | | | ayr | ãyr | | | | |
| aw | ãw | awn | awm | | awl | ãwl | | | awr | ãwr | | | | |
| oy | õy | oyn | oym | | oyl | õyl | | | oyr | õyr | | | | |

V = VOWEL; Ṽ = NASALIZED VOWEL

FIG. 3A

SYSTEM AND METHOD FOR HYBRID SPEECH SYNTHESIS

This invention was made with government support under grant number R44 DC006761-02 awarded by the National Institutes of Health. The government has certain rights in the invention.

BACKGROUND OF THE DISCLOSURE

1. Field of the Invention

The present disclosure relates generally to speech synthesis from symbolic input, such as text or phonetic transcription.

2. Background Information

In the past, a variety of systems have been developed that are able to synthesize audible speech from unconstrained symbolic input, such as user-provided text, phonetic transcription, and other input. When text is used as the symbolic input, these systems are commonly referred to as text-to-speech systems.

Such systems generally include a linguistic analysis component (a front end module) that converts the symbolic input into an abstract linguistic representation (ALR). An ALR depicts the linguistic structure of an utterance, which may include phrase, word, syllable, syllable nucleus, phone, and other information. (In some systems, the ALR may also include certain quantitative information, such as durations and fundamental frequency values.) The ALR is passed to a speech generation component (a back end module) that uses the information in the ALR to produce waveforms approximating human speech. A variety of back end approaches have been developed, yet most follow one of two predominant strategies.

The first strategy is often referred to as Rule-Based Speech Synthesis (RBSS). In this strategy, a set of context-sensitive rules is applied to the ALR to yield perceptually appropriate parameter values, such as formant (i.e., vocal tract resonance) frequencies. From these parameter values, a speech synthesizer produces a speech waveform. As used herein, the term speech synthesizer refers only to the specific back end component that produces a waveform from the parameter values, and does not include other components of a speech synthesis system, such as rules. The most widely used RBSS strategy is Rule-Based Formant Synthesis (RBFS), in which the rules directly produce formant frequencies, formant bandwidths, and other acoustic parameter values. Formants appear in speech spectrograms as frequency regions of relatively great intensity, and are important to human perception of speech. Vowels, for example, can often be identified by characteristics of their two or three lowest frequency formants, and the trajectories of formant frequencies at the edges of vowels are often perceptually important cues to the place and manner of articulation of adjacent consonants.

The parameter values produced by an RBFS system are passed to a formant-based speech synthesizer, or formant synthesizer, which uses them to produce a speech waveform. An example of a commonly used formant synthesizer is described in Dennis H. Klatt & Laura C. Klatt, *Analysis, Synthesis, and Perception of Voice Quality Variations is Among Female and Male Talkers,* 87(2) Journal of the Acoustical Society of America, 820-857 (1990), which is herein incorporated by reference.

RBFS systems have a number of advantages. For example, given appropriate rules, they produce smooth, readily intelligible speech. They also generally have a small memory footprint, are highly predictable (i.e., the characteristics and quality of speech output vary little from one utterance to the next), and can easily generate different voices, voice characteristics (e.g., different degrees of breathiness), pitch patterns, rates of speech, and other properties of speech output "on the fly."

Unfortunately, offsetting these positive aspects are certain prominent shortcomings. Foremost among these is that speech generated by RBFS systems generally sounds distinctly non-human, having a machine-like timbre, or voice quality. Such speech, while often highly intelligible, would not generally be mistaken for natural human speech. The non-human voice quality of RBFS speech is often particularly pronounced with voices that are intended to mimic female or child speakers. A related shortcoming of RBFS systems is that they are generally poorly suited to producing voices that mimic particular human speakers.

The second back end strategy, Concatenative Speech Synthesis (CSS), offers its own set of advantages and disadvantages. In CSS, speech segments originally derived from recorded human speech (henceforth speech units) are extracted from a database and concatenated to produce the desired utterance.

CSS systems differ as to the number, size, and types of speech units that are employed. Early systems generally employed short, fixed length speech units. Rather than being stored directly as waveforms, the units in these early systems were generally stored in a more compact parameterized form obtained through signal processing, for example in terms of Linear Predictive Coding (LPC) coefficients. A speech synthesizer was then used to construct waveforms from the parameter values. One particularly common type of unit, still in use today, was the diphone (i.e., the second half of one phone followed by the first half of the next, including the transitional portion between the phones). In early diphone systems, for a given combination of phonemes (i.e., each vowel and consonant of the language) usually only a single predetermined unit was stored. For example, for any pair of phonemes, such as /b-a/, /d-a/, /b-i/, /d-i/ etc., a diphone system would generally store a single corresponding speech unit. Such systems, however, while simple, had a number of problems, not the least of which was that due to both the nature of the units themselves and the limited number of them, these systems could not produce many of the required contextual variants of phonemes necessary for natural-sounding speech.

To overcome these problems, more recent CSS systems have employed a much larger number of speech units, often of varying sizes, which are stored directly as waveforms. In fact, modern unit selection synthesis systems often store in their speech databases large numbers of entire phrases or sentences, which are segmented, or labeled, into more basic components, or basic speech units, such as diphones. The precise type of the basic speech units differs depending on the system, with examples including diphones, half-phones, demisyllables, and triphones. Note that in a unit selection synthesis system, in contrast to the early CSS systems discussed above, for a given sequence of phones, there may be many different variants of basic speech units and sequences thereof that could be selected from the database. Regardless of the precise nature of the units, however, the goal of a unit selection system generally remains the same: since there are often many possible units that can be selected to construct a given utterance, the goal is to realize the utterance represented by the ALR by selecting the most appropriate sequence of units from the speech database.

In order to minimize the number of concatenation points, where audible discontinuities and other problems resulting in speech quality degradations may occur, unit selection synthesis systems often attempt to select the longest sequences of adjacent basic speech units possible that will meet the constraints imposed by the unit selection algorithms. In some situations, basic unit sequences encompassing entire words or phrases may be selected. When necessary, however, unit selection synthesis systems must resort to constructing the phoneme sequences in question out of the basic speech units, such as the diphones or half-phones, selected from non-adjacent portions of the stored utterances.

Unit selection CSS systems have the potential to produce reasonably natural-sounding speech, especially in select situations where long sequences of contextually appropriate adjacent basic speech units from a stored utterance can be utilized. However, this potential is offset by a variety of shortcomings. For example, with existing methods, it has proved difficult to produce speech that is at the same time natural-sounding, intelligible, and of consistent quality from utterance to utterance and from voice to voice. Further, higher quality CSS systems often introduce extensive memory and processing requirements, which render them suitable only for implementation on high-powered computer systems and for applications that can accommodate these requirements. Furthermore, even when the necessary processing power and storage requirements are available, large speech databases are still problematic. The more speech that is recorded and stored, the more labor-intensive database preparation becomes. For example, it becomes more difficult to accurately label the speech recordings in terms of their basic speech units and other information required by the back end speech generation components. For this and other reasons, it also becomes more time-consuming and expensive to add new voices to the system.

One challenge facing the developer of a speech synthesis system designed to produce speech from unconstrained input stems from the fact that although there are a limited number of speech sounds, or phonemes, that humans perceive for any given dialect, these phonemes are realized differently in different contexts. Among the factors that influence the acoustic realizations (variants) of a phoneme are the neighboring segments of the phoneme, the amount of stress of the syllable containing the phoneme, the phoneme's syllable position, word position, and phrase position, and the rate of speech.

Consider, for example, the words dad and bat. These words each have the same vowel phoneme /æ/. However, when these words are spoken, the directions and other characteristics of the formant transitions at the beginning of the vowel (reflecting the movement of the articulators from the initial consonant [d] or [b] into the vowel) differ in each case. The particular characteristics of the formant transitions are important perceptual cues to the place of articulation of the word-initial consonant. Thus the words dad and bat could not be created using the same vowel units. In fact, the important perceptual function of different formant transitions is one of the main motivating factors behind the use of diphones and other common basic units underlying CSS synthesis, which are generally designed to preserve these transitions.

However, it is not only the transitions at the edges of vowels that may differ in different contexts, but other portions of vowels as well. For example, another important perceptual difference between the vowels in dad and bat in many dialects of English is that the vowel of dad is considerably longer than that of bat (provided that both words occur in otherwise similar contexts), since the vowel precedes a voiced consonant ([d]) in the same syllable as opposed to a voiceless one ([t]). The different vowel durations in the two words are perceptually important cues to the voicing characteristics of the post-vocalic consonants. To complicate matters further, transition and non-transition portions of vowels may lengthen and shorten non-uniformly (e.g., transitions at the edges of vowels may remain relatively stable in duration while the remaining portion of the vowel lengthens). Formant values and other characteristics of vowels may also be influenced by a variety of contextual factors. Thus in a system that constructs vowels from separate units (e.g., separate diphones) originally spoken in different utterances and/or contexts, it is a challenge to select the units not only such that they produce appropriate transitions for the context, but also appropriate overall durations, formant patterns, and the like. The difficulty of producing appropriate acoustic patterns is compounded by the fact that what are linguistically single vowels are often split across the basic units underlying CSS systems.

There is a need, then, for new techniques that improve upon both the existing RBSS and CSS techniques used in the back end of speech synthesis systems. While RBSS techniques, at least in principle, have the flexibility to produce virtually any contextual variant that is perceptually appropriate in terms of duration, fundamental frequency, formant values, and certain other important acoustic parameters, the production of human-sounding voice quality or speech that mimics a particular speaker has remained elusive, as mentioned above. While certain CSS techniques at least in principle can mimic particular voices and create natural-sounding speech in cases where appropriate units are selected, excessively large databases are required for applications in which the input is unconstrained, and further, the unit selection techniques themselves have been less than adequate.

Specifically, synthesis techniques are needed that can be used in a single synthesis system that combines the best features of RBSS and CSS systems, rather than trading one feature for another. Such techniques should provide for human-sounding speech, the ability to mimic particular voices, cost-efficient development of voices, dialects, and languages, consistent speech output, and use of the system on a large range of hardware and software configurations including those with minimal memory and/or processing power.

SUMMARY OF THE DISCLOSURE

A hybrid speech synthesis (HSS) system, as defined herein, is one that is designed to produce speech by concatenating speech units from multiple sources. These sources may include one or more human speakers and/or speech synthesizers. A general goal of the HSS system described herein is to be able to produce a variety of high-quality and/or custom voices quickly and cost-efficiently, and to be of use on a wide range of hardware and software platforms. This disclosure will describe several embodiments that may help achieve these goals, and provide other advantages as well.

In the description below, a voice that the system is designed to be able to synthesize (i.e., one that the user of the system may select) is called a target voice. A target voice is derived from one or more speech corpora, such as one or more target voice corpora or shared corpora, and/or one or more RBSS systems. A target voice corpus is one whose main purpose is to capture certain characteristics of a particular human voice (generally a human speaker from whom units in the corpus were originally recorded). A shared corpus is one containing units that may be used to produce more than one target voice.

Both target voice corpora and shared corpora may include Phone-and-Transition speech units (henceforth P&T units). A P&T unit is a sequence of one or more phone and/or transition segments, where a phone, as the term is used herein, is generally the steady state or quasi-steady state portion of a phoneme-sized speech segment that characterizes a speech sound in question. A transition, as the term is used herein, is generally the portion of the acoustic signal between two phones, and usually includes the formant transitions that result from the articulatory movement from one phone to the next. For example, in the words dad and bat, the phone portions that realize the phonemes /æ/ in each case may be similar, but the initial transitions in each case would differ. The transition between [b] and [æ], for instance, may include a rising second formant, while the transition between [d] and [æ] may include a falling one. Two transitions never occur in sequence within a P&T unit, but all other sequential combinations of phones and transitions are possible (e.g., phone, transition, phone plus transition, phone plus phone, transition plus phone, transition plus phone plus transition, etc.). The phone and transition segments in a given P&T unit are generally adjacent in the speech recording from which they were originally taken. Within each P&T unit, the beginnings and ends of each phone and transition may be labeled. Other information may be labeled as well, such as formant frequencies at the beginning and end of each phone. As shown below, there may be advantages to the use of a P&T representation for many types of speech units in an HSS system, including syllable nucleus units.

Syllable nucleus units (or simply nucleus units) are of importance in HSS since these units are often the main ones responsible for the perception of specific voice characteristics and human-sounding voice quality. While the exact types of linguistic units that constitute a syllable nucleus depend on the particular language and dialect being synthesized and on the system implementation, such a unit generally includes at least the vowel (or diphthong) of the syllable, and sometimes also post-vocalic sonorants, such as /l/ or /r/, that are in the same syllable as the vowel. Since certain nucleus units contribute heavily to voice characteristics, in some configurations of an HSS system it may be desirable to derive these units from a particular target voice corpus; many other units may be drawn from one or more shared corpora and/or may be synthesized, e.g., via RBFS.

As will be shown below, with a P&T representation for syllable nuclei and/or other units, several embodiments are possible that help solve problems that have faced RBFS and CSS systems. For example, it is possible to avoid concatenations of stored units at locations such as the middles of vowels or sonorant sequences, where particularly egregious artifacts may occur when the two segments being joined do not match well in terms of their formant frequencies, fundamental frequency values, or certain other acoustic attributes. At the same time, the speech corpora within the unit database are kept manageable in size, so that the system may be suitable for use on a wide range of hardware platforms and new voices may be prepared cost-efficiently. Finally, because the types of units most responsible for the basic quality of the target voice are taken from natural speech, the system, although relatively small, successfully produces speech with the intended voice quality.

In one embodiment of the present disclosure, at least some of the stored speech units are P&T units called prototype speech units (or simply prototype units). Other contextually necessary speech units are constructed from the phone and transition components of these prototype units using P&T adaptations, and such variant speech units are called adapted speech units (or simply adapted units). Generally an inventory of prototype units is carefully chosen to allow for a wide range of adaptations and consistent adaptation strategies across classes of unit types (e.g., all syllable nuclei). However, there may also be situations in which one or more prototype units may serve directly as concatenative units for the construction of utterances without undergoing P&T adaptations. The prototype units are extracted directly from specific contexts in natural speech recordings, whereas the adapted units are derived using P&T adaptations on the basis of general principles through modifications made to the prototype units. Typically, similar kinds of prototypes, such as syllable nuclei, are extracted from similar linguistic contexts, as illustrated further below.

In another embodiment of the present disclosure, instead of storing otherwise similar prototype units with different transitions at one or both edges (e.g., an [a] unit for use after a [b] and another for use after a [d]), the prototype units are stored without these transitions and the transitions are synthesized, for example using RBSS. The synthesized transitions are concatenated with the prototype units and/or with adapted units on one side and with the relevant preceding and/or following units on the other.

In these ways, a broad range of contextually necessary speech units can be produced with a limited number of stored units for any given voice, with little if any degradation of speech quality.

BRIEF DESCRIPTION OF THE DRAWINGS

The description below refers to the accompanying drawings, of which:

FIG. 3A is a table that shows a sample set of American English syllable nuclei each of which may be represented by one or more prototype units in a target voice corpus in an example HSS system;

DETAILED DESCRIPTION OF EXAMPLE EMBODIMENTS

Figure 1A:
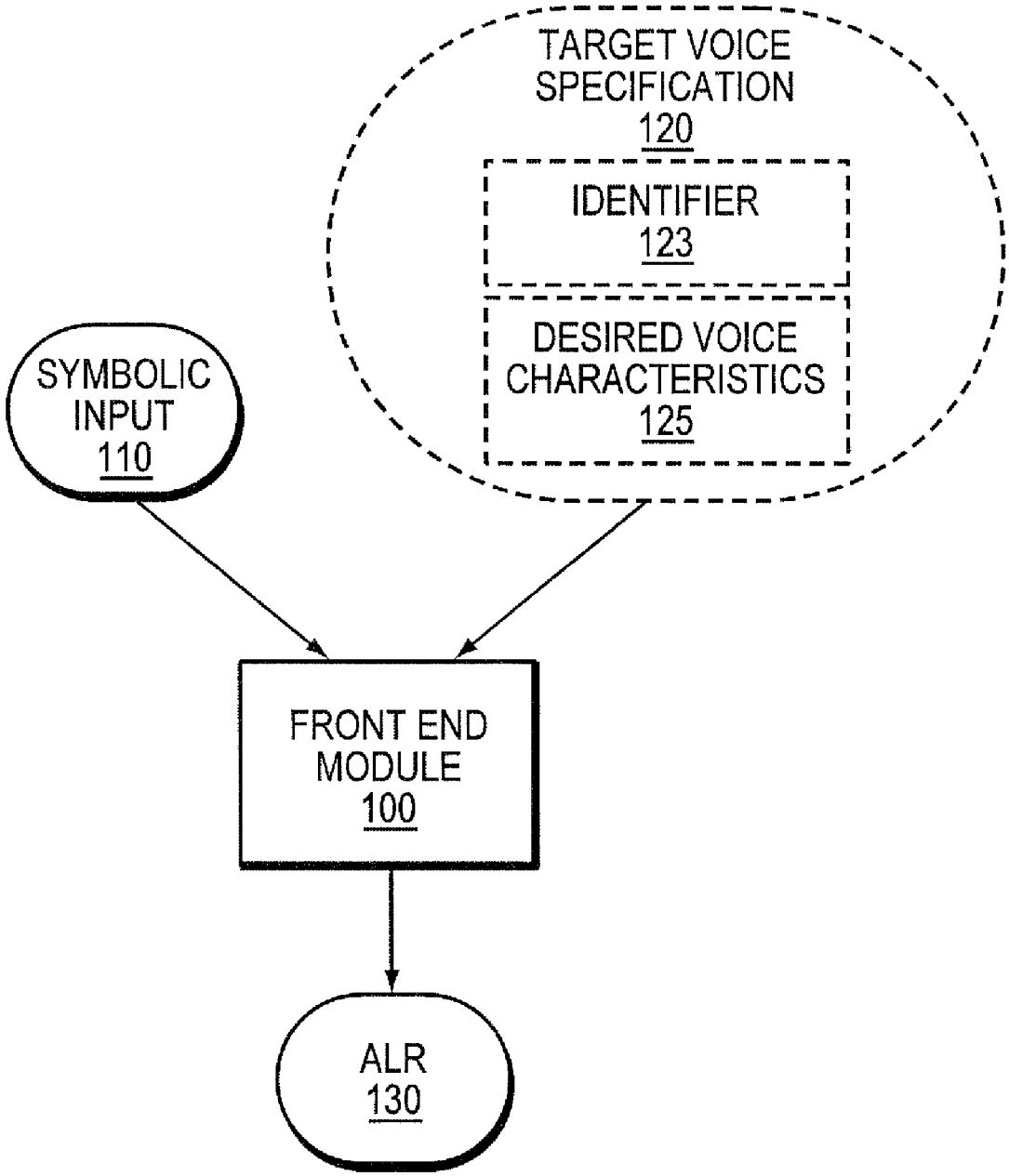
FIG. 1A is a schematic block diagram of a front end module of an example HSS system.

As mentioned above, an HSS system is herein defined as a speech synthesis system that produces speech by concatenating speech units from multiple sources. These sources may include human speech or synthetic speech produced by an RBSS system. While in the examples below it is sometimes assumed that the RBSS system is a formant-based rule system (i.e., an RBFS system), the invention is not limited to such an implementation, and other types of rule systems that produce speech waveforms, including articulatory rule systems, could be used. Also, two or more different types of RBSS systems could be used.

As discussed above, a voice that the system is designed to be able to synthesize (i.e., one that the user of the system may select) is called a target voice. The target voice may be one based upon a particular human speaker, or one that more generally approximates a voice of a speaker of a particular age and/or gender and/or a speaker having certain voice properties (e.g., breathy, hoarse, whispered, etc.). A given target voice in an HSS system is produced, at least in part, from a particular target voice corpus that provides certain characteristics of the target voice. Often the target voice corpus is recorded from the particular human speaker whose voice is used as the basis for the target voice. In some configurations, however, a target voice corpus may be subjected to signal processing techniques such that the resulting target voice will have different voice properties from the human speaker from whom the corpus was originally recorded. In some configurations, the speech units in the target voice corpus may also include units from more than one speaker. For example, a particular speaker whose voice is to be modeled may not make a certain phonemic distinction in his or her dialect that is desirable for certain applications. For instance, the speaker might not have the distinction between /a/ and /ɔ/.

In order to be able to produce a dialect in which this distinction is made, one might record all but the missing vowel or vowels from the voice of the target speaker, and the missing vowel(s) from a speaker with compatible voice properties. Alternatively, synthesized renditions of the missing vowels (or other types of synthesized speech units) with appropriate voice properties might be added to the database. Because syllable nuclei are particularly important for conveying voice characteristics, a target voice corpus typically includes at least some syllable nucleus units.

A shared corpus is an inventory of stored speech units that may be used to produce more than one target voice. A shared corpus is more generic than a target voice corpus in that its units are specifically chosen to be appropriate for use in the production of a broader range of voices. A shared corpus may include speech units from one or more sources. These sources may be human speech recordings or synthetic speech.

Both target voice corpora and shared corpora are generally tagged with their relevant properties. For example, a target voice corpus may be tagged with properties such as language, dialect, gender, specific voice characteristics and/or speaker name. A shared corpus may be tagged for use with a particular group of target voice corpora.

In the examples below it is assumed that the speech units in the target voice and shared corpora are stored as waveforms. However, the invention should not be interpreted as limited to such an implementation, as speech units may alternately be stored in a variety of other forms, for example in parameterized form, or even in a mixture of forms.

Several of the embodiments discussed below make reference to Phone-and-Transition speech units (or simply P&T units). As discussed above, a P&T unit consists of a sequence of one or more phone and/or transition segments. Generally these segments are adjacent in the original speech waveform from which they were taken. All combinations of phones and transitions are possible except for ones with adjacent transitions. Typically, the beginnings and ends of phones and transitions within P&T units stored in a corpus are labeled. Other information, including formant frequencies and fundamental frequency, may also be associated with specific phones and/or transitions or groups or subportions thereof within a P&T unit.

Further details relating to a P&T model of speech may be found in Susan R. Hertz, *Streams, Phones and Transitions: Towards a Phonological and Phonetic Model of Formant Timing,* 19 Journal of Phonetics, 91-109 (1991), which is herein incorporated by reference.

Overview of an Example Hybrid Speech Synthesis System

FIG. 1A is a schematic block diagram of a front end module 100 that may be used with an example HSS system. Such a front end module may be implemented in software, for example as executable instruction code operable on a general purpose processor, in hardware, for example as a programmable logic device (PLD), or as a combination thereof with both software and hardware components.

The front end module 100 accepts symbolic input 110, such as ordinary text, ordinary text interspersed with prosody or voice annotations (e.g., to indicate word emphasis, desired voice properties, or other characteristics), phonetic transcription, or other input, and produces an ALR 130 as output.

While some or all of the target voice characteristics may be provided as part of the symbolic input 110, some or all may also be specified independently, as a separate optional target voice specification 120 that is passed to the front end module 100 and/or to a back end module (discussed below in reference to FIG. 2A). The target voice specification 120 may include an identifier 123, such as a name of a specific target voice corresponding to a list of available target voices in the system, or alternatively it may include a set of desired voice characteristics 125, such as gender, age, and/or particular voice properties (e.g., breathy, non-breathy, high-pitched, low-pitched, etc.) The HSS system may use the target voice specification 120 as part of its decision concerning the speech sources from which to extract different units for concatenation, as discussed further below.

Figure 1B:
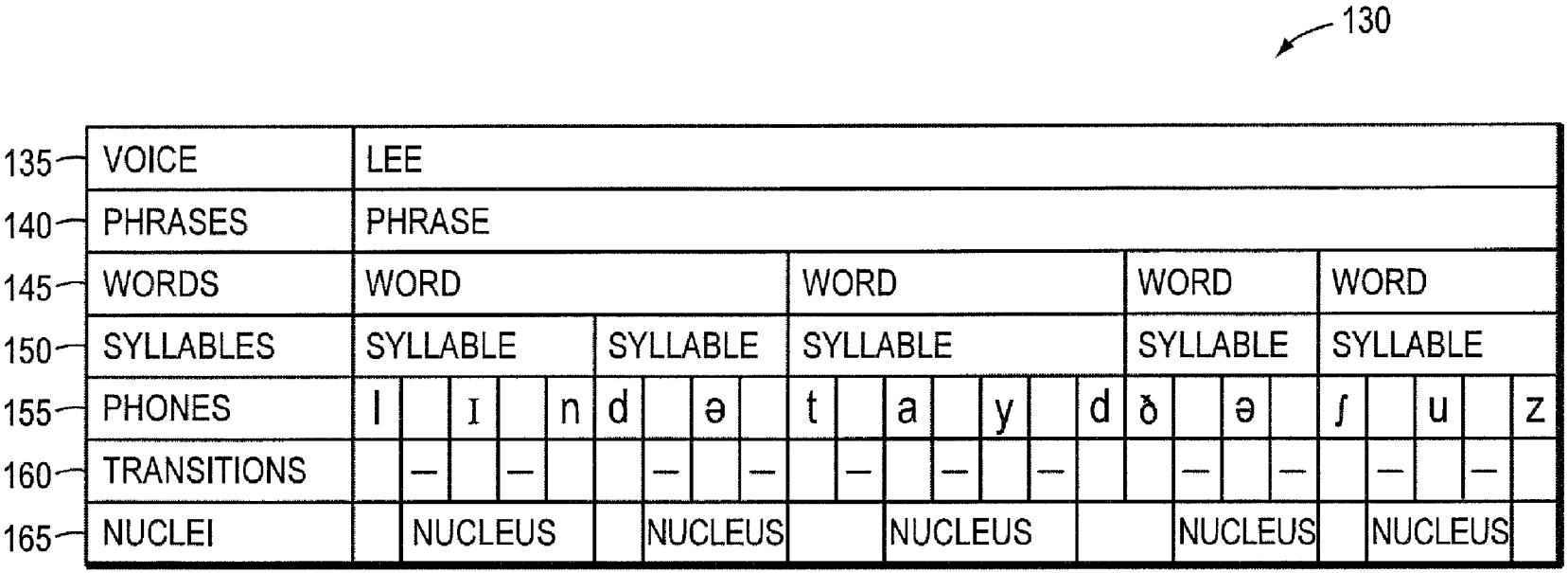
FIG. 1B is an example ALR produced by an example front end module of an example HSS system.

FIG. 1B shows an example ALR 130 produced by an example front end module 100 of an example HSS system. The example ALR 130 is shown in a tabular arrangement, but such an arrangement is merely for purposes of illustration, and the ALR 130 may be embodied in any of a number of computer-readable data structures. In the configuration shown, the first tier 135 in the ALR 130 associates a particular target voice with the utterance. A target voice may also be associated only with selected portions of the utterance if some portions of an utterance are to be produced with one voice and some with another. Further, in some other configurations, target voice information may not be part of the ALR 130 at all and may instead be provided as separate input in a target voice specification 120. A combination of methods may also be used to specify the target voice.

The remaining ALR tiers 140-165 identify the linguistic units of the utterance, including phrases 140, words 145, syllables 150, phones 155, transitions 160, and nuclei 165. Optionally, each unit in a tier may be associated with inherent or context-dependent features not shown in FIG. 1B. For example, syllables may be marked as stressed or unstressed; phones may be marked for manner of articulation, place of articulation, and other features; and transitions may be marked as aspirated or voiced.

The tiers in FIG. 1B are structured in accordance with the nucleus-based Phone-and-Transition model described in Susan R. Hertz & Marie K. Huffman, A *Nucleus-Based Timing Model Applied to Multi-Dialect Speech Synthesis by Rule,*

2 Proceedings of the International Conference on Spoken Language Processing, 1171-1174 (1992), which is hereby incorporated by reference. The particular tiers, units, and general structure shown in FIG. 1B are for purposes of illustration only and may differ depending on various factors, including the system configuration or the language being synthesized. For example, while in English the transition following the [t] of tied is typically aspirated (and hence not considered part of the nucleus in the ALR 130), in another language a transition between a syllable-initial [t] and a following vowel may be voiced and hence considered part of the nucleus. In general, the information in the ALR 130 along with any separate input target voice specification 120 (e.g., concerning target voice characteristics) provide a sufficient basis from which the system's back end module 200 (shown in FIG. 2A) can produce a speech waveform.

The front end module 100 may rely upon commercially available front end components for some functionality, or it may be completely custom-built. If commercially available front end components are employed, their output may be enhanced to include additional tiers of information or other kinds of information of use to the system's back end module 200. A more conventional ALR may be enhanced, for example, to include transition units, with appropriate phones and transitions further grouped into higher-level syllable nucleus units in a fashion similar to that shown in FIG. 1B.

Figure 2A:
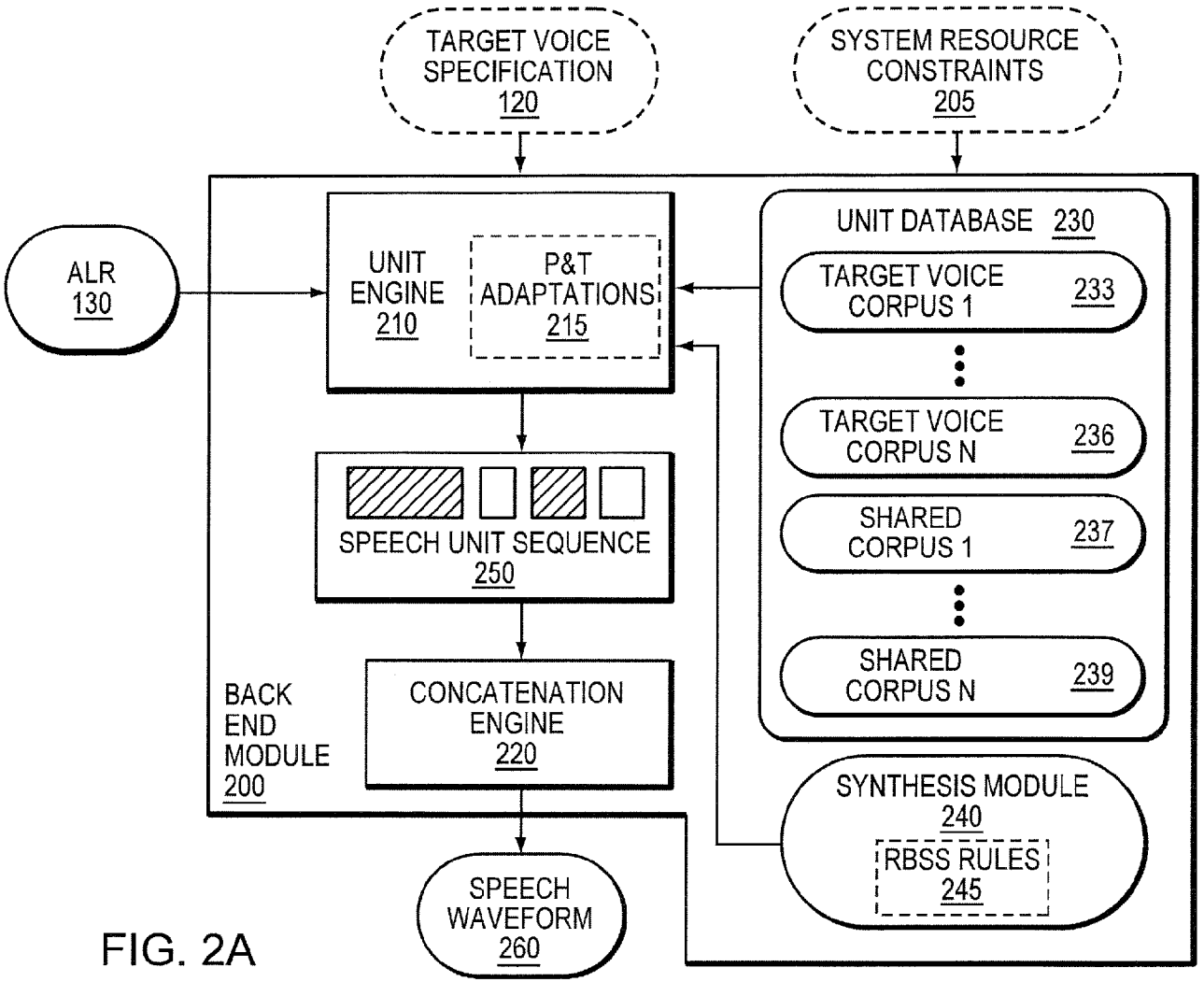
FIG. 2A is a schematic block diagram of a back end module of an example HSS system.

FIG. 2A is a schematic block diagram of an example back end module 200 of an example HSS system. Like the front end module 100, the back end module 200 may be implemented in software, for example as executable instruction code operable on a general purpose processor, in hardware, for example as a programmable logic device (PLD), or as a combination thereof with both software and hardware components.

The ALR 130 is passed to the back end module 200 where a unit engine 210 coupled with a concatenation engine 220 uses it to produce a final speech waveform 260. More specifically, on the basis of the ALR information 130, the back end module 200 constructs a sequence of speech units 250 and concatenates them to produce the final speech waveform 260. Each speech unit may be derived from a unit stored in a target voice corpus 233 (possibly of several available target voice corpora 233-236, if more than one target voice is to be used in the utterance) or in a shared corpus 237 (possibly of several available shared corpora 237-239) of a unit database 230, or it may be generated by a speech synthesizer within a speech synthesis module 240, for example from the output of a set of RBSS rules 245, such as RBFS rules. In general, each target voice is produced from one target voice corpus (or one or more subcorpora thereof) while shared corpora are used for several target voices.

The optional target voice specification 120 may be passed to the back end module 200. As mentioned above, the target voice specification 120 provides information about the desired voice characteristics of the speech to be produced by the system. In addition to the target voice specification 120, a set of system resource constraints 205, including memory, performance and/or other types of constraints, may be passed to the back end module 200. Jointly, the target voice specification 120 and the system resource constraints 205 may influence the choices made by the back end module. For example, consider a system in which the primary goal of the target voice specification 120 is to mimic a particular speaker, while the system resource constraints 205 dictate low unit storage requirements. In this case, the back end module 200 may be structured with a small target voice corpus 233 from which those units most essential for recognizing the intended speaker (i.e., the target voice) are taken, with all other units produced "on the fly" using RBSS rules 245, such as RBFS rules. The back end module 200 may adjust dynamically to a specific set of choices regarding desired voice characteristics and/or selected system resource requirements, or it may be preconfigured in accordance with specific choices.

While in some configurations the front end module 100 may complete all of its processing before the back end module 200 starts its processing, in other configurations the processing of the front end module 100 and the back end module 200 may be interleaved. Processing may be interleaved on a phrase-by-phrase basis, a word-by-word basis, or in any of a number of other ways. Further, in some configurations, certain portions of the front end and back end processing may proceed simultaneously on different processors.

In certain configurations of the system, only selected portions of target voice and/or shared corpora, as well as RBSS rules 245, may be stored. As mentioned above, for example, in a system designed to conserve memory, only a subset of a particular target voice corpus 233 may be stored to produce those units that are most essential for capturing speaker identity (with other units produced, for example, with RBSS). Also, in some configurations, a given target voice corpus 233, shared corpus 237, or RBSS rule set 245 may be divided into logical subgroups containing units that share properties that facilitate certain system design goals. For example, to facilitate the production of multivoice, multi-dialect, and multi-language systems, and combinations thereof, RBSS rules 245 and speech corpora may be structured into subgroups with different levels of generality, with one subgroup relevant to all languages or a group of languages, one to all dialects of a particular language, another to a particular dialect, etc.

The units constructed in the back end module 200, whether from the unit database 230 or via RBSS rules 245, are joined by the concatenation engine 220 to produce a speech waveform 260. In order to avoid certain types of discontinuities, particularly where voiced waveform units are joined together, the concatenation engine 220 may employ a join technique, such as the well-known Pitch Synchronous Overlap and Add (PSOLA) technique. If some units are synthesized by RBSS, the synthesis module 240 may advantageously extend the ends of the units to achieve better overlap results. For example, an extension may be a short segment whose formant frequencies and other acoustic properties match those of the portion of the neighboring natural speech unit to be overlapped. In general, however, in an embodiment of an HSS system in which many of the stored units are P&T units rather than the more standard types of basic units used in CSS systems, and in which other units are selected or constructed to match them at their edges, the need for overlap techniques may be greatly diminished.

The waveform 260 produced by the concatenation engine 220 may be passed to a playback device (not shown), such as an audio speaker; it may be stored in an audio data file (not shown), for example a .wav file; or it may be subjected to further manipulations and adjustments.

Figure 2B:
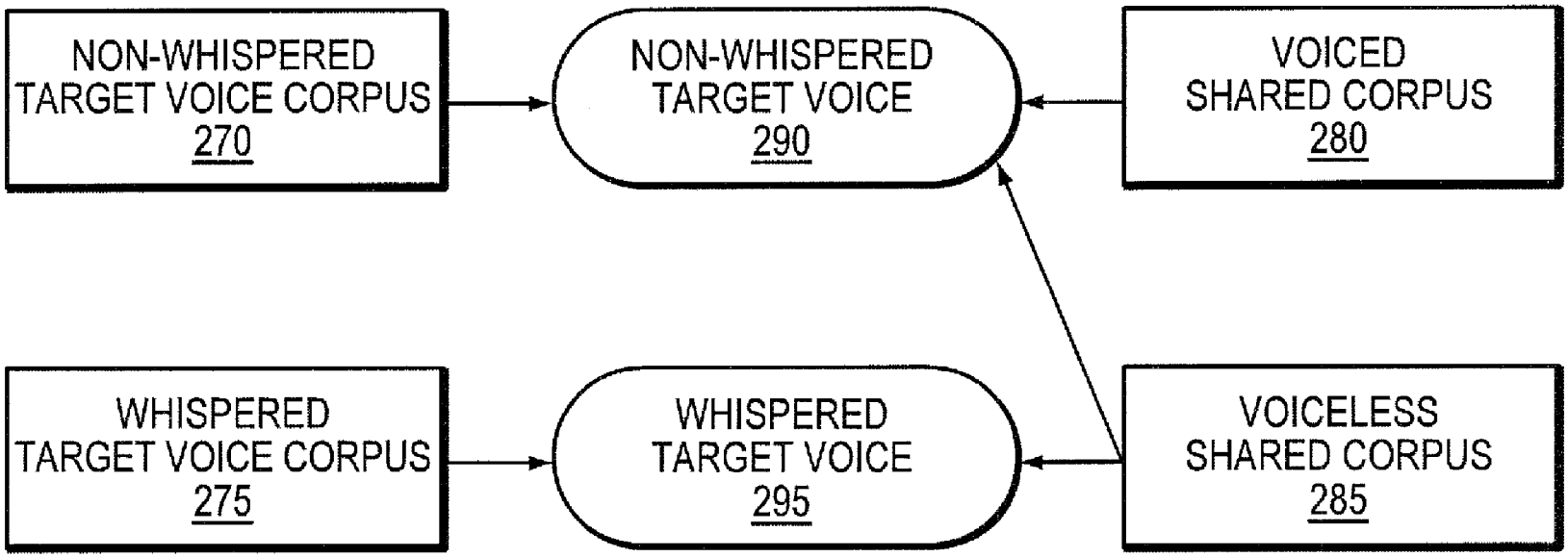
FIG. 2B is a schematic block diagram of an example HSS system configuration that demonstrates how different target voices can be produced through different combinations of target voice and shared corpora.

A system configured in the general manner described above may offer a number of advantages. For example, strategic combinations of speech corpora and/or RBSS rules may be used to produce different types of voices. FIG. 2B shows an example arrangement of two target voice corpora 270, 275 and two shared corpora 280, 285 that may be used by the back end module 200 to construct a non-whispered voice 290 and a whispered voice 295. In addition to units from the non-whispered target voice corpus 270, which may, for example, include voiced syllable nucleus units, non-whispered target voice 290 also uses units from the voiced shared corpus 280 and the voiceless shared corpus 285, which may include, for example, voiced and voiceless consonants, respectively. Whispered target voice 295, on the other hand, is constructed from the whispered target voice corpus 275, which may include voiceless syllable nuclei, and the voiceless shared corpus 285, which may include voiceless consonants. The non-whispered shared corpus 280 is not required for the whispered target voice 295, since a whispered voice does not generally have voiced consonants. The voiced and voiceless shared corpora 280, 285 may also be used by other target voices (not shown), and the non-whispered and whispered target voice corpora 270, 275 could in certain circumstances also be used to produce other target voices (not shown), for example, by applying signal processing techniques to modify their voice qualities.

Configurations that produce substantial portions of the final speech waveform 260 using sources other than a target voice corpus, whether by RBSS or through the use of one or more shared corpora, offer certain advantages. Sharing a speech corpus for different target voices, for example, generally reduces storage requirements for configurations requiring the production of multiple voices. It also generally reduces the number of units (and hence, the amount of speech) that must be recorded for a new target voice, allowing the system to be more readily tailored to different target voices. That is, to add a new target voice to the system, although a new target voice corpus may have to be constructed, the shared corpus (or corpora) and/or RBSS rules may remain largely unchanged. For both storage and development efficiency, the sources from which the shared corpora are constructed may advantageously be chosen to have speech with characteristics specifically desirable for a large set of target voices.

Further, the use of RBSS rather than natural speech for certain units may offer several additional advantages. For example, a small set of rules may tailor rule-generated units to have appropriate spectral properties for the voice being modeled. For instance, the rules may produce higher centers of gravity in fricatives and/or stop bursts for female target voices than they would for male ones. Similarly, the rules may intentionally produce breathy or less breathy units as appropriate for the voice being modeled. RBSS is also particularly well-suited to the generation of "interpolation segments" in which, due to coarticulation with neighboring units, the frequencies of one or more of the formants in the units are realized acoustically as interpolations between the formant frequencies at the edges of the neighboring units. For example, in a P&T model, such interpolation segments may include both voiced and aspirated transitions as well as one or more of the formants of reduced vowel phones in certain contexts. Note that since reduced vowels do not influence speaker identity to the same extent as, for example, stressed nuclei, and since they often coarticulate in predictable ways with their surrounding contexts, they may be good candidates for production using RBSS in certain configurations of an HSS system.

Techniques for Construction of Adapted Speech Units from Prototype Speech Units

Various techniques may be employed to reduce the size of the unit database 230 and/or to enhance the quality of the speech waveform 260 produced by the back end module 200 of an HSS system. Several of these techniques relate to the adaptation of stored speech units to create contextually appropriate variants.

As mentioned above, speech units generally have a large number of perceptually relevant contextual variants determined by factors such as segmental context, phrasal context, word position, syllable position, and stress level. Storing an extended number of contextual variants not only results in an undesirably large unit database, but also increases the burden on the system developer, who must record, label, test, and otherwise manage the unit database 230.

In one embodiment of the present disclosure, at least some of the stored speech units in the target voice corpora 233-236 and/or the shared corpora 237-239 are P&T units called prototype units. Other contextually necessary speech units, called adapted units, are constructed from the phone and/or transition components of these prototype units by the unit engine 210 using P&T adaptations, which make context-sensitive modifications to the phone and/or transition components of the prototype units and/or to portions of these components. The prototype units are generally chosen to minimize the size of the unit database by facilitating a wide range of possible adaptations. The unit engine 210 chooses which P&T adaptations 215 to apply using knowledge of the types of variation in natural speech that are perceptually relevant and the sorts of context-dependent modifications that are necessary to achieve intelligible, natural, and/or mimetic speech output. In choosing the specific adaptations to apply, the engine may take into account any provided target voice specification 120 and/or any system resource constraints 205.

The P&T adaptations 215 may modify prototype units in a variety of ways. For example, an adaptation 215 may extract a certain portion of a unit; it may remove a certain portion of a unit; it may shorten, stretch, or otherwise adjust the duration of all or a portion of a unit; it may modify the amplitude or fundamental frequency of all or a portion of a unit; it may time reverse a unit or portion thereof; it may filter entire phones and/or transitions or portions thereof (e.g., to remove certain frequency components); or it may perform several of the aforementioned and/or other types of modifications. Any contiguous portion of a unit may be modified, including the entire unit, a particular phone and/or transition, a contiguous sequence of phones and transitions, or some other portion beginning and/or ending partway through a phone or transition. As demonstrated below, many of the P&T adaptations 215 utilize the P&T structure of the units and more generally the P&T model of speech.

In some configurations, the stored prototype units include ones intended for use as syllable nuclei. These units are extracted from selected speech contexts in natural speech such that nuclei for a variety of other contexts can be produced from them via P&T adaptations 215. Since a large number of nucleus variants are needed for producing intelligible and natural-sounding speech, the number of stored units required for producing a target voice may be substantially reduced by producing variants via P&T adaptations, rather than storing the variants.

The exact linguistic units that constitute a syllable nucleus may vary depending on the particular language or dialect being synthesized and the system implementation, but a syllable nucleus generally includes at least a vowel (or diphthong) of a syllable. A syllable nucleus for many dialects of English may also include post-vocalic sonorants, such as /l/ or /r/, that are in the same syllable as the vowel. FIG. 3A is a table 300 that shows a sample set of nuclei for a particular dialect of American English, where each nucleus is considered to include the vowel of a syllable plus any following sonorants (including nasals) in the same syllable. The symbols are shown in International Phonetic Alphabet form except that /y/ is used in place of /j/ (for example, /ay/ rather than /aj/ for the nucleus of died). When nuclei are defined in this manner, there are approximately 50 distinct syllable nuclei for the particular dialect of American English under consideration.

For each of these distinct nuclei, a reasonable number of different prototype units may be recorded from selected speech contexts from natural speech and stored in a target voice corpus 233. These prototypes may include units appropriate for different phrasal, stress, or other contexts, as well as ones with different transition shapes at the nucleus edges. While the details of how many and which variants need to be recorded, stored, and used for any particular HSS system may vary, in virtually any system the unit database 230 will be substantially smaller than those used in most modern CSS unit selection systems. In fact, in some configurations the unit database may be so small that only a single unit (which may be further adapted) may be appropriate for any given context. In such configurations, each unit and its adaptations may be determined by knowledge-based rules, a method that stands in sharp contrast to unit selection procedures, which generally select the best candidates based on more statistical, data-driven search algorithms.

Figure 3B:
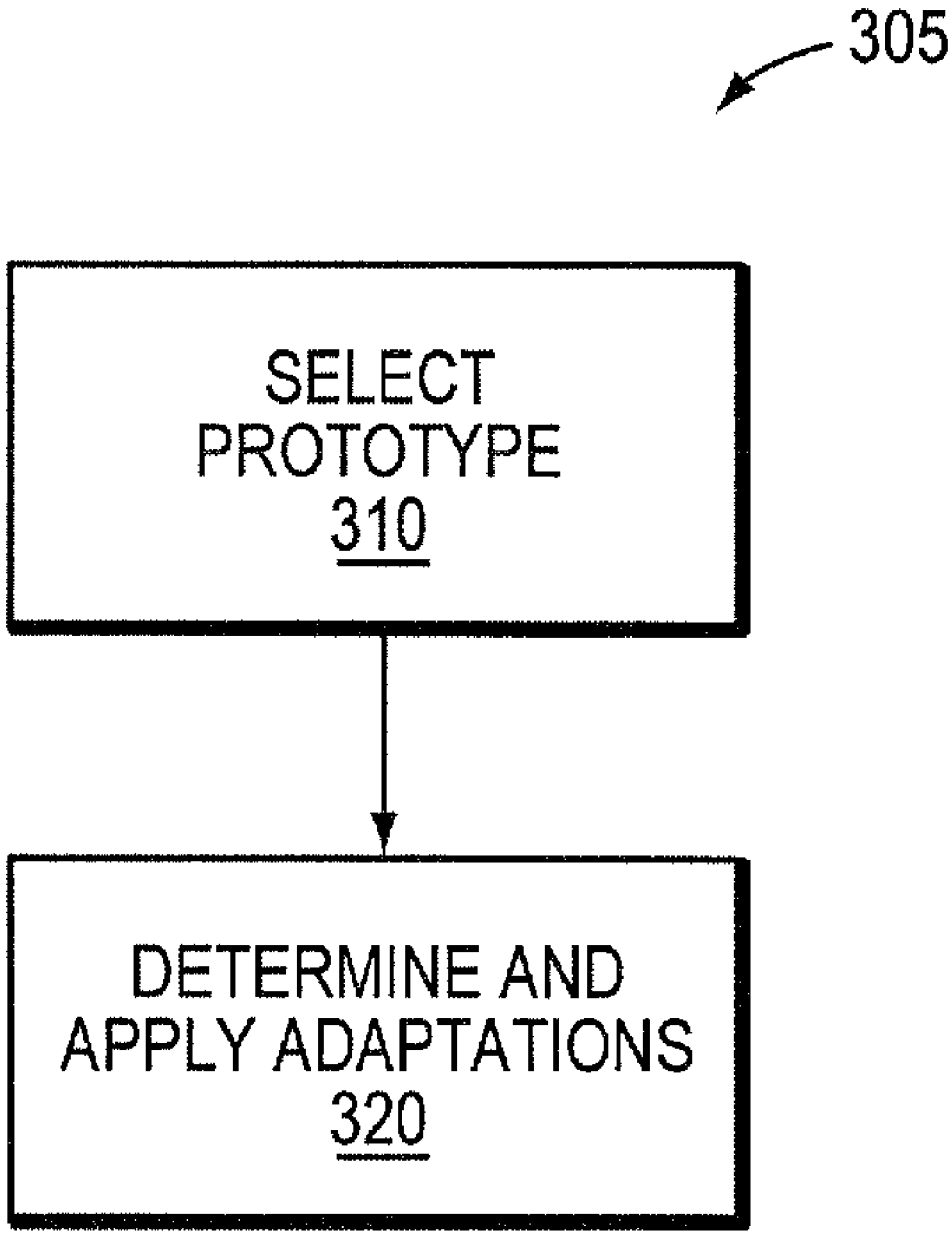
FIG. 3B is a flow diagram of an example series of steps that may be employed to construct an adapted unit from a stored prototype unit.

FIG. 3B is a flow diagram 305 of an example series of steps that may be employed to construct a new unit from a stored prototype syllable nucleus. At step 310, an appropriate prototype syllable nucleus is selected, for example from the target voice corpus 233, though not necessarily therefrom. At step 320, the unit engine 210 determines a set of adaptations, if any, and applies them to the unit.

Figure 4A:
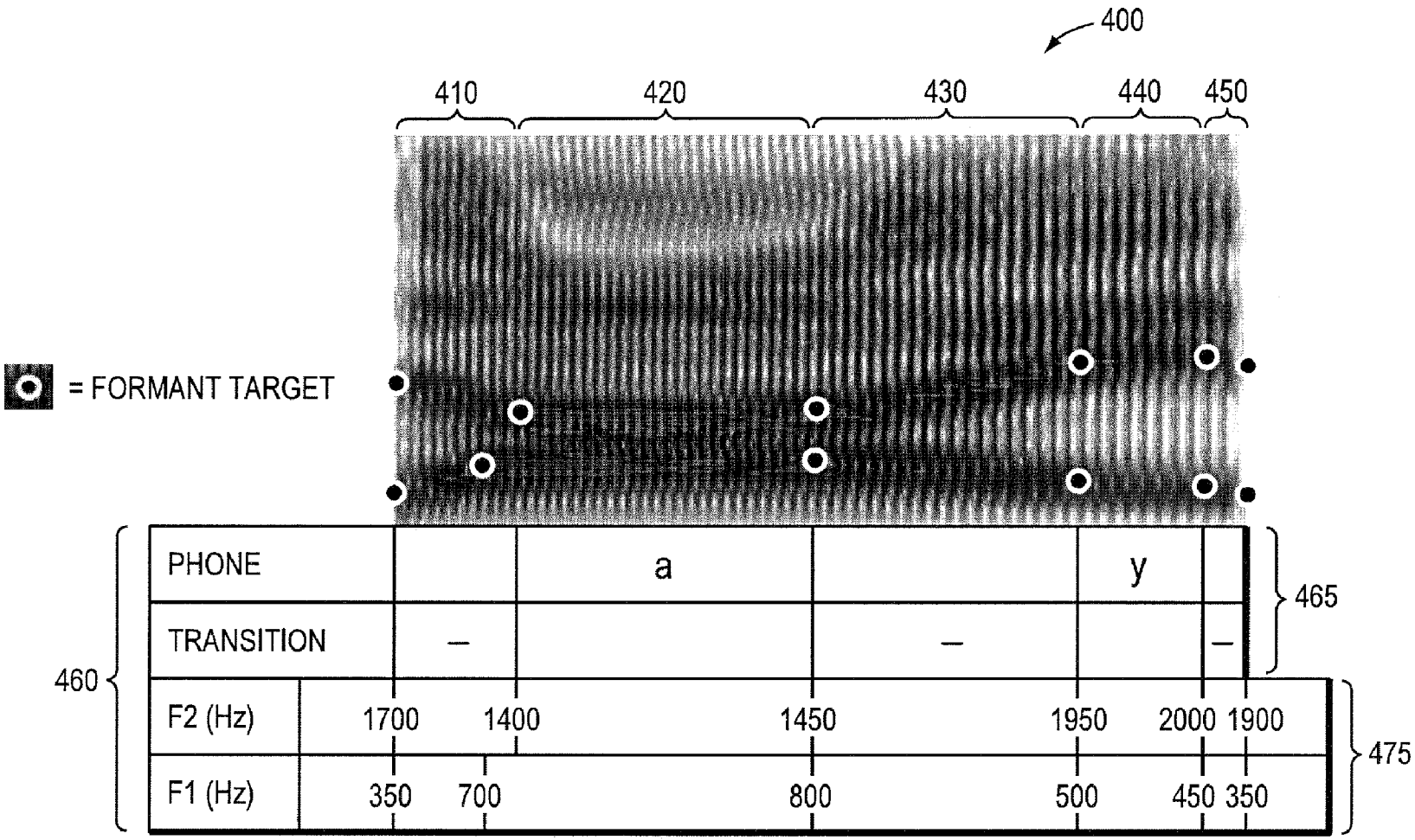
FIG. 4A shows an example prototype unit for the English nucleus /ay/ (as in died) that may be stored in an example HSS system, and gives an example of annotations, or labels, that may be associated with such a unit for use by the back end module of the HSS system.

The construction of adapted units from stored prototypes may be illustrated by specific examples. Assume, for example, that a speech corpus contains the nucleus units in FIG. 3A, including for each nucleus a variant originally recorded in the carrier phrase Say d_d. FIG. 4A shows an example labeled prototype unit 400 for the nucleus /ay/ (as in died) extracted from this context in the speech of a particular speaker. This nucleus prototype consists of three transitions and two phones: the transition from [d] to [a] 410, the phone [a] 420, the transition from [a] to [y] 430, the phone [y] 440, and the transition from [y] to [d] 450. The beginnings and ends of each of these phones and transitions are labeled. In accordance with the P&T model, the second formant inflection points (i.e., formant targets) mark the boundaries between transition and phone units. For purposes of illustration, the first and second formant targets have been marked with small circles on the spectrogram. Note that the initial F1 (first formant) target of [a] is slightly to the left of the initial F2 (second formant) target, but otherwise the various formant targets in this example align with each other in time at the phone and transition edges. The grid 460 below the spectrogram shows some of the information that may be labeled and stored along with the prototype unit, including the beginnings and ends of the phones and transitions (in grid region 465) and the associated first and second formant targets (in grid region 475). This information is shown for illustrative purposes only. Many other types of information may be stored, including fundamental frequency values. Also, some required values may not be stored, but may be extracted from the units "on the fly" when these units are used.

Figure 4B:
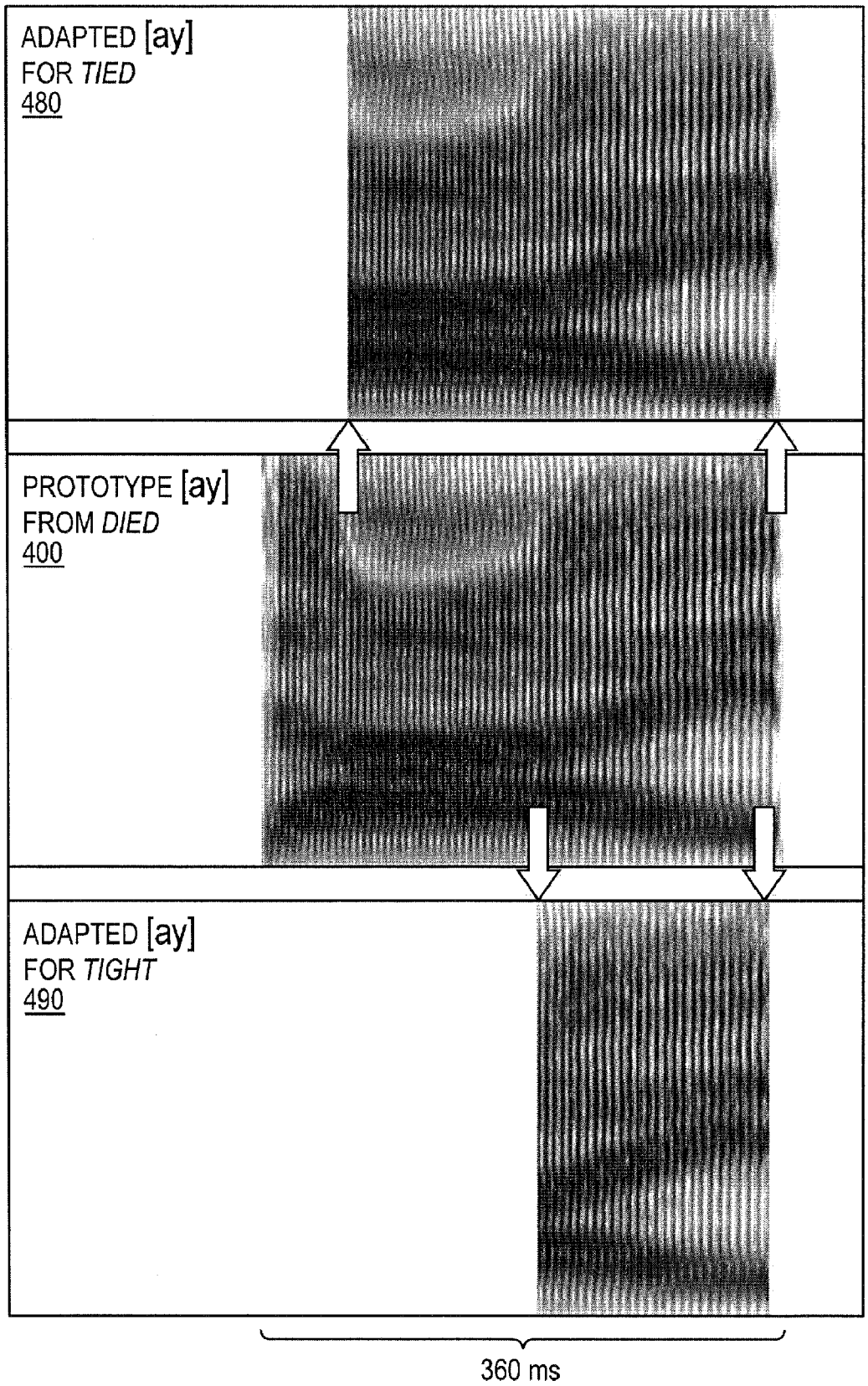
FIG. 4B shows several example spectrograms that illustrate how the example prototype nucleus in FIG. 4A may be adapted through P&T adaptations into variants for use in different contexts.

FIG. 4B shows several example spectrograms that illustrate how the prototype unit 400 in FIG. 4A (i.e., [ay] extracted from Say died) may be adapted to construct variant syllable nucleus units for other contexts. To create a syllable nucleus unit 480 for the word tied ([tayd]) spoken in a similar overall utterance context (i.e. phrase-finally, with a similar stress level, etc.), the prototype unit 400 from died may be subject to one or more P&T adaptations 215 that eliminate the initial voiced transition 410, to construct a unit that can be concatenated with the aspirated transition that tied requires. As discussed further below, in one embodiment this aspirated transition may be generated using RBSS rules 245 that use the formant information associated with the prototype 400, as shown in FIG. 4A, to create a transition that connects smoothly with the [a] unit.

To create the appropriate syllable nucleus unit 490 for the word tight, one or more different P&T adaptations 215 may be applied. As described above for tied, the initial voiced transition 410 may be eliminated so it can be replaced with an appropriate aspirated transition. In addition, a large portion of the beginning of the steady state [a] vowel phone 420 may be eliminated, based on knowledge that this phone shortens when the diphthong precedes a tautosyllabic voiceless obstruent as opposed to a voiced one. Further, a small portion of the end of the final transition 450 from the glide [y] to the final [t] may also be eliminated to create the effect of early cessation of voicing before syllable-final voiceless obstruents. Although not shown, it may be perceptually necessary to shorten the [y] phone as well.

In a similar manner, the syllable nucleus 400 from the word died may be used to create other variants for other contexts. For instance, while the voiced [d] to [a] transition 410 was in effect removed in the examples above, for other variants all or part of the voiced [d] to [a] transition 410 may be used. For example, the transition 410, with a small portion of the beginning of the transition 410 eliminated, may be used to construct an [ay] nucleus to be adjoined with a preceding [s]. (The transition from [s] to [a] is often not as long as the one from [d] to [a], since [s] noise tends, in effect, to obliterate the early part of the transition.) Further, a prototype unit extracted from one context in natural speech may also sometimes be appropriate without any modification for another context.

While the P&T adaptations described above focus on manipulations of strategic portions of P&T components of nucleus prototypes, the P&T adaptations are not limited to the specific adaptations illustrated, nor are they applicable only to nucleus units. Many other types of P&T adaptations, designed to apply to any type of stored prototype unit, including consonant units, may be used in an HSS system. As discussed above P&T adaptations may extract a certain portion of a unit; may remove a certain portion of a unit; may shorten, stretch, or otherwise adjust the duration of all or a portion of a unit; may modify the amplitude or fundamental frequency of all or a portion of a unit; may time reverse a unit or portion thereof; may filter entire phones and/or transitions or portions thereof (e.g., to remove certain frequency components), or may perform several of the aforementioned and/or other types of modifications. Accordingly, it is contemplated that a wide variety of signal processing techniques may be applied to the speech units to construct perceptually relevant variants.

While both prototype and adapted units typically realize the same phonemes as those from which the prototypes were taken, in some configurations these units may also realize different phonemes or phoneme sequences. For example, for some voices and linguistic contexts the second phone of the diphthong [ay] may be used to realize the phone [ɪ]. Similarly, the waveform for the prototype [ay] from certain contexts may be reversed to construct [ya]. Furthermore, what was a transition segment in the original prototype may be adapted to produce a phone segment or vice versa, since phones in some situations have formant values that differ considerably at their left and right edges, and may thus have acoustic shapes in some contexts that are similar to segments functioning as transitions in other contexts.

In general, an HSS system that stores a limited number of P&T units as prototypes and uses and/or adapts these for a broad range of contexts based on a set of knowledge-based principles concerning the behavior of phones and transitions (and the larger units that encompass these) makes possible the production of high-quality speech with relatively low storage requirements. Storage requirements can be further reduced by synthesizing transitions using RBSS as described in the next section.

Techniques for Synthesizing Transitions

In another embodiment of the present disclosure, certain transitions are synthesized by the synthesis module 240 in FIG. 2A and then concatenated with prototype units and/or adapted units that do not have transitions at one or both of their edges, thereby eliminating the need to store a large number of otherwise similar prototype units with differing initial and/or final transitions in a speech corpus of the unit database 230. In this way, the required number of stored speech units may be dramatically reduced, and particular sorts of concatenation artifacts that have commonly plagued CSS systems may be eliminated.

Figure 5A:
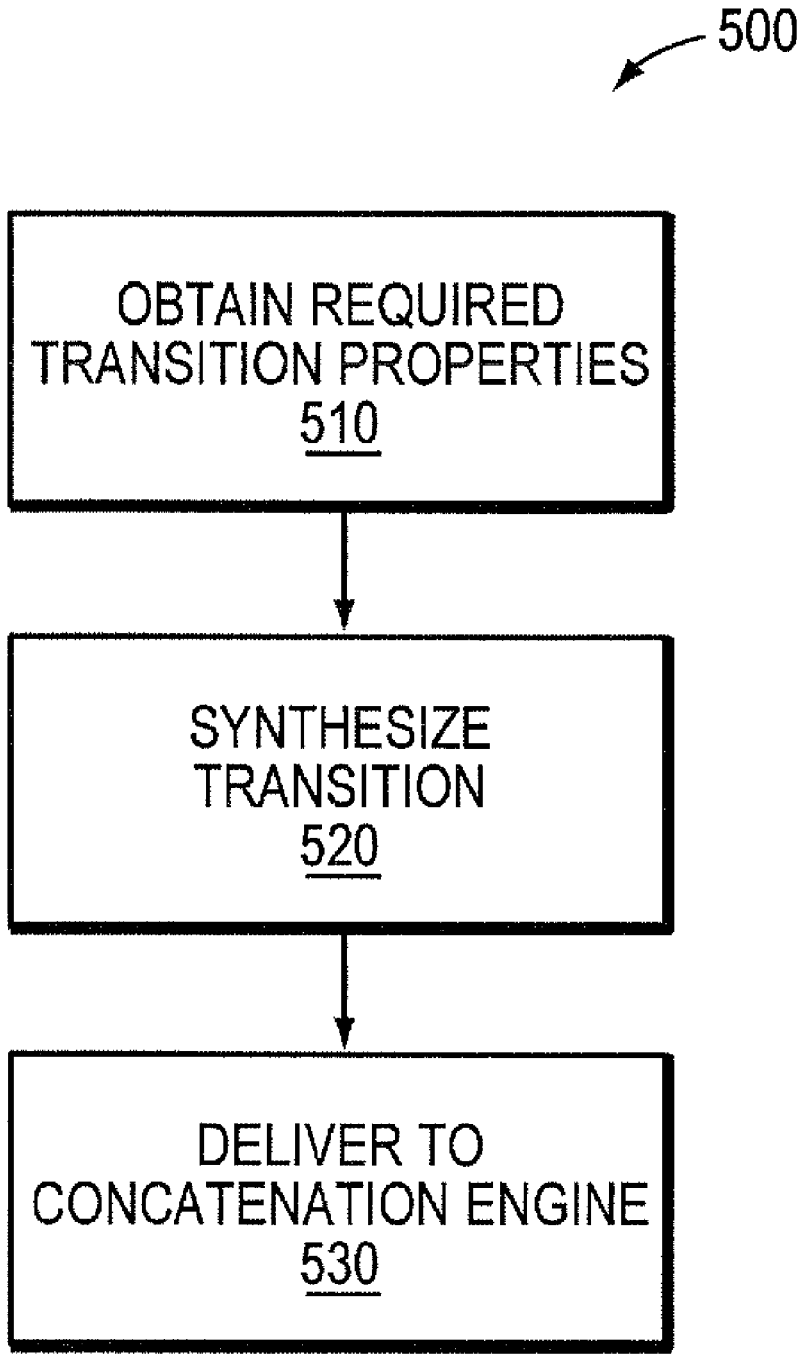
FIG. 5A is a flow diagram of an example series of steps for synthesizing a transition to be concatenated with neighboring natural speech units.

FIG. 5A is a flow diagram 500 of an example series of steps for synthesizing a transition designed to connect the end of one unit and the beginning of another. At step 510, the required transition properties are obtained. This information may include properties such as the transition's duration, starting and ending formant frequencies and/or bandwidths, amplitudes, fundamental frequencies, etc. Some of these properties, such as formant frequencies, may be obtained directly from the units being connected (either from information stored along with the units in the unit database 230 or by extracting the information from the units at execution time via signal processing techniques); other properties, such as the transition's duration, may be calculated by algorithms in the back end module 200 using knowledge-based principles. Alternatively, if a unit on either side of the transition is synthesized, or its precise formant frequencies or other parameter values are not crucial (e.g., as for some consonants), these values may be supplied by rules in the synthesis module 240. At step 520, the required transition is synthesized using RBSS rules 245, for example RBFS rules, in the synthesis module 240 to produce a transition with the necessary starting and ending formant frequencies, and which has otherwise appropriate characteristics. At step 530, if necessary, the synthesized transition unit is delivered to the concatenation engine 220 to be concatenated with neighboring units. In some cases, as shown in FIG. 5C below, a transition synthesized together with a preceding and/or following synthetic unit may be synthesized as one continuous sequence, and may hence not require concatenation.

Figure 5B:
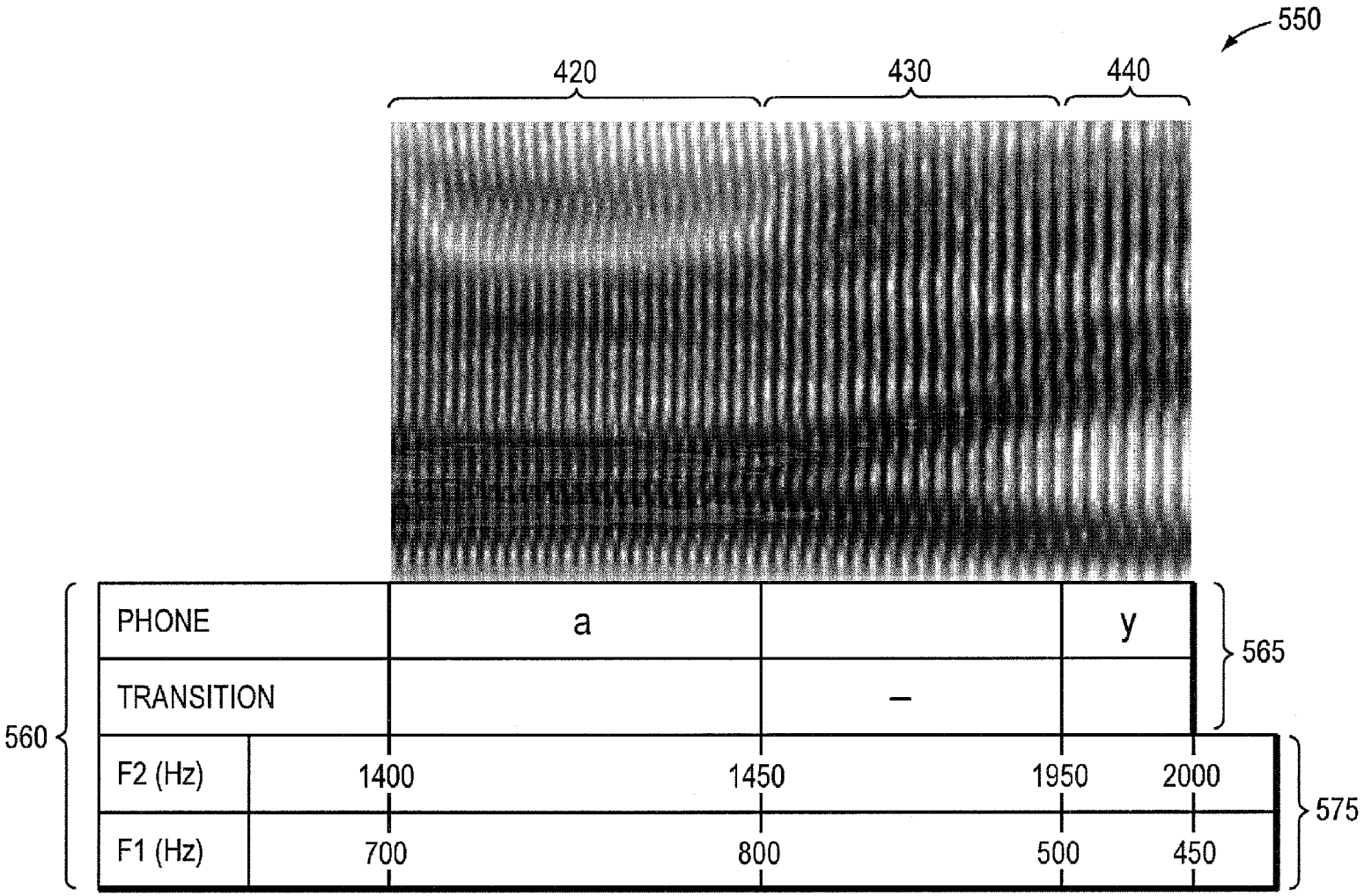
FIG. 5B shows the same annotated example prototype unit as in FIG. 4A, except that it has no initial and final transitions.

This technique may be illustrated by specific examples. FIG. 5B shows the same syllable nucleus prototype 400 as in FIG. 4A ([ay] from the context Say died) but stored without initial and final transitions. That is, the prototype 550 consists solely of the phone [a] 420, the transition from [a] to [y] 430, and the phone [y] 440, and does not include the [d] to [a] 410 or [y] to [d] 450 transitions. As in FIG. 4A, the grid 560 below the spectrogram shows some of the information that may be labeled and stored along with the prototype unit, including the beginnings and ends of the phones and transitions (in grid region 565) and the associated first and second formant targets (in grid region 575). This information is shown for illustrative purposes only.

Figure 5C:
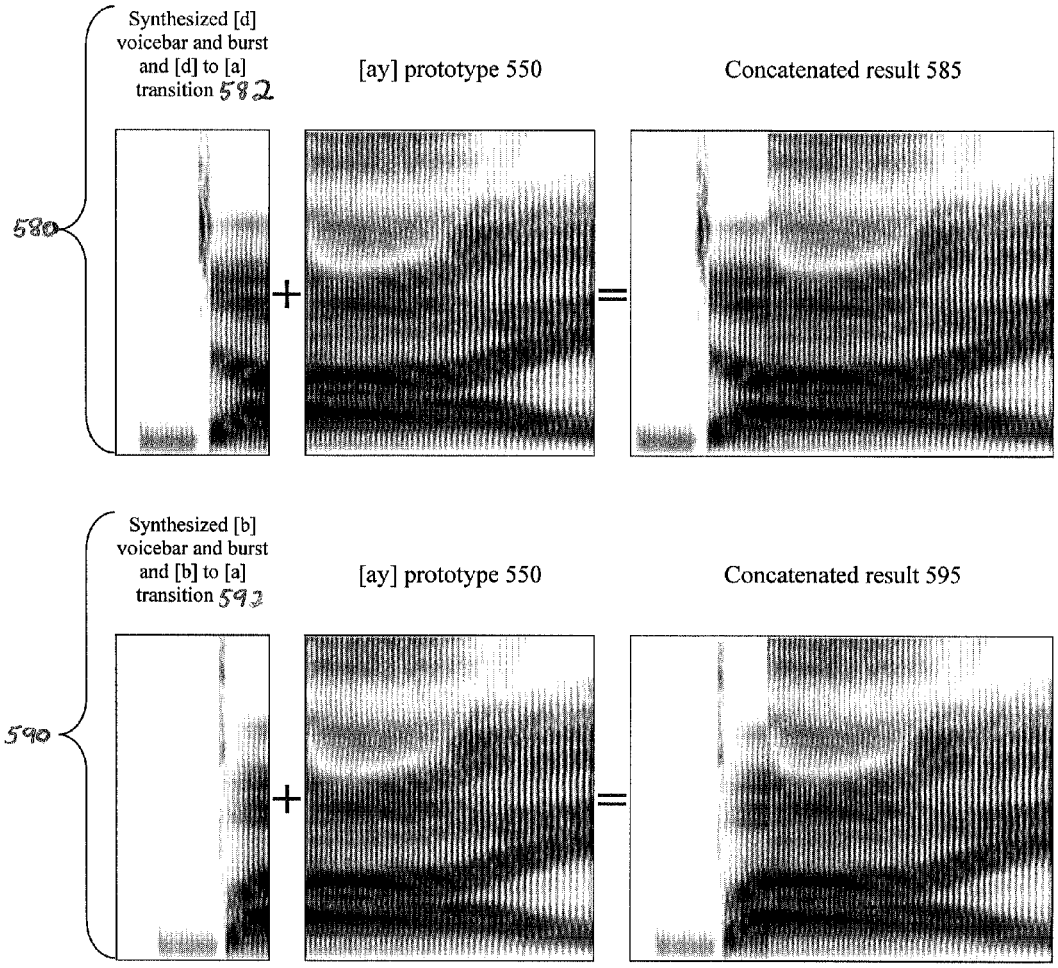
FIG. 5C shows a series of example spectrograms that illustrate how different synthesized transitions may be concatenated with the prototype unit in FIG. 5B as appropriate for different consonantal contexts.

FIG. 5C illustrates how synthesized transitions may be constructed and concatenated with the prototype shown in FIG. 5B as appropriate for different segmental contexts. In particular, the figure shows how the same prototype can be used for the words bye and die despite the very different initial voiced formant transitions in these words. Among other differences, the second formant rises during the transition from [b] to [a], while it falls during the transition from [d] to [a]. The top portion of the FIG. 580 illustrates how a concatenated result 585 appropriate for the word die may be constructed from a stored prototype 550 by concatenating it with a synthesized [d] (in this case a voice bar and [d] burst) and an acoustically appropriate [d] to [a] transition 582. The bottom portion of the FIG. 590 illustrates how the same stored prototype unit 550 can be used to construct a concatenated result 595 appropriate for the word bye by concatenating a synthesized [b] (i.e., voice bar and [b] burst) and acoustically appropriate [b] to [a] transition 592. ([d] and [b] or portions thereof, such as just the bursts, could alternatively be taken from a speech corpus.) The formant frequencies in the synthesized transitions start at values appropriate for the right edge of the [d] or [b] unit and end at the formant targets of the left edge of the [a] phone stored for the prototype in the database, as shown in FIG. 5B. The same prototype could be concatenated with a large number of other transition shapes at its left or right edge as appropriate for a broad range of segmental contexts. The acoustic properties of the specific transitions required in each case, including durations, formant frequencies, voice quality characteristics (e.g., degrees of breathiness), and other properties, may be produced by RBSS rules 245, and/or by using information associated with units to which the transitions are being attached (either obtained from information stored with the units in the database or "on the fly" from the units during program execution).

In certain situations, to achieve smooth concatenation results it may be desirable to synthesize extension segments at the ends of transitions that will overlap the natural speech phones with which they are concatenated. These segments may have acoustic properties carefully chosen to ensure a smooth join. For example, an extension may consist of a short segment that has the formant frequencies, fundamental frequency, and other properties of the portion of the neighboring natural speech phone to be overlapped.

While the above example illustrates the synthesis of transitions in consonant-vowel sequences within the same syllable, any transitions may be synthesized, including transitions across syllable boundaries. Synthesis of transitions between vowels across syllable boundaries (e.g., between the two vowels of trio) eliminates the need to store long prototype units containing sequences of nuclei, or units in which nuclei are divided at undesirable locations. Further, in some alternate embodiments, some transitions may be synthesized, while others may be stored, for example a particular transition that is problematic to synthesize.

CONCLUSION

The foregoing has been a detailed description of several embodiments of the present disclosure. Further modifications and additions may be made without departing from the disclosure's intended spirit and scope. It should be remembered that various of the teachings above may be used together or practiced separately. For example, a system may be constructed that provides for prototype adaptations and transition synthesis, only for prototype adaptation, only for transition synthesis, etc. Further, one is reminded that the above-described techniques may be implemented in hardware, for example programmable logic devices (PLDs), software, in the form of a computer-readable storage medium having program instructions written thereon for execution on a processor, or a combination thereof.

It is the object of the appended claims to cover all such variations and modifications as come within the true spirit and scope of the invention.

What is claimed is:

1. A method for synthesizing a target voice, the method comprising:

receiving symbolic input descriptive of an utterance to be synthesized;

selecting one or more portions of the utterance to be constructed from certain Phone-and-Transition (P&T) speech units that function as prototype speech units, the prototype speech units obtained from a target voice corpus, the target voice corpus including speech units recorded from a human speaker, the target voice corpus configured to provide characteristics of the target voice;

applying adaptations to selected ones of the prototype speech units of the target voice corpus that are derived from a context different than the one in which they are to be used in the utterance, to produce adapted units that are contextually appropriate for the utterance;

obtaining at least some speech units from a source other than the target voice corpus; and concatenating at least the adapted speech units from the target voice corpus and the speech units from the source other than the target voice corpus to produce a speech waveform for the utterance.

2. The method of claim 1 wherein the adaptations are Phone-and-Transition (P&T) adaptations, wherein at least some of the P&T adaptations consider boundaries of phone or transition components of the prototype speech units.

3. The method of claim 1 wherein at least some of the prototype speech units represent syllable nuclei.

4. The method of claim 1 wherein all the speech units of the target voice corpus are recorded from one particular human speaker whose voice is the basis for the target voice.

5. The method of claim 1 wherein the speech units of the target voice corpus are recorded from two or more different human speakers.

6. The method of claim 1 wherein the adaptations comprise an adaptation that extracts and uses only a selected portion of a phone or a transition of one of the stored prototype speech units.

7. The method of claim 1 wherein the adaptations comprise an adaptation that extracts and uses only a selected portion of one of the stored prototype speech units.

8. The method of claim 1 wherein the adaptations comprise an adaptation that adjusts the duration of at least a portion of one of the stored speech units.

9. The method of claim 1 wherein the adaptations comprise an adaptation that modifies the amplitude of at least a portion of one of the stored prototype speech units.

10. The method of claim 1 wherein the adaptations comprise an adaptation that time reverses at least a portion of one of the stored prototype speech units.

11. The method of claim 1 wherein the adaptations comprise an adaptation that uses a portion of one of the stored prototype speech units to realize a phoneme other than one realized in the original utterance from which the prototype was extracted.

12. The method of claim 1 wherein the source other than the target voice corpus comprises a shared corpus that includes speech units recorded from a different human speaker than the human speaker used to record the target voice corpus, and wherein the shared corpus is configured to be used in synthesizing multiple different target voices.

13. The method of claim 12 wherein the shared corpus further includes synthesized speech units.

14. The method of claim 12 wherein the shared corpus includes a plurality of prototype speech units, and the method further comprises:

applying adaptations to selected ones of the prototype speech units of the shared corpus, to produce adapted speech units that are contextually appropriate for the utterance.

15. The method of claim 1 wherein the source other than the target voice corpus is a plurality of shared corpora that are each recorded from a different human speaker, and wherein each shared corpus is configured to be used in synthesizing multiple different target voices.

16. The method of claim 1 wherein the step of obtaining at least some speech units from a source other than the target voice corpus further comprises:

synthesizing the at least some speech units with Rule-Based Speech Synthesis (RBSS) rules.

17. The method of claim 1 wherein the target voice corpus further includes synthesized speech units.

18. A method for speech synthesis, the method comprising:

receiving symbolic input descriptive of an utterance to be synthesized;

selecting one or more portions of the utterance to be constructed from certain Phone-and-Transition (P&T) speech units that function as prototype speech units, the prototype speech units obtained from a speech corpus, the speech corpus including speech units recorded from a human speaker;

applying Phone-and-Transition (P&T) adaptations to selected ones of the prototype speech units of the speech corpus that are derived from a context different than the one in which they are to be used in the utterance, to produce adapted speech units that are contextually appropriate for the utterance; and concatenating at least the adapted speech units from the speech corpus to produce a speech waveform for the utterance.

19. The method of claim 18 wherein the P&T speech units comprise one or more phones and transitions.

20. A system for synthesizing a target voice, comprising:

a processor; and a storage medium having program instructions written thereon for execution on the processor, the program instructions including program instructions for:

a front end module configured to receive symbolic input descriptive of an utterance to be synthesized, a back end module configured to select one or more portions of the utterance to be constructed from certain Phone-and-Transition (P&T) speech units that function as prototype speech units, the prototype speech units obtained from a target voice corpus, the target voice corpus including speech units recorded from a human speaker, the target voice corpus configured to provide characteristics of the target voice, a unit engine of the back end module configured to apply adaptations to selected ones of the prototype speech units of the target voice corpus that are derived from a context different than the one in which they are to be used in the utterance, to produce adapted speech units that are contextually appropriate for the utterance, and a concatenation engine of the back end module configured to concatenate at least the adapted speech units from the target voice corpus and speech units from a source other than the target voice corpus, to produce a speech waveform for the utterance.

21. The system of claim 20 wherein the adaptations are Phone-and-Transition (P&T) adaptations, wherein at least some of the P&T adaptations consider boundaries of phone or transition components of the prototype speech units.

22. The system of claim 20 wherein at least some of the prototype speech units represent syllable nuclei.

23. The system of claim 20 wherein all the speech units of the target voice corpus are recorded from one particular human speaker whose voice is the basis for the target voice.

24. The system of claim 20 wherein the speech units of the target voice corpus are recorded from two or more different human speakers.

25. The system of claim 20 wherein the adaptations comprise an adaptation that extracts and uses only a selected portion of a phone or a transition of one of the stored prototype speech units.

26. The system of claim 20 wherein the adaptations comprise an adaptation that extracts and uses only a selected portion of one of the stored prototype speech units.

27. The system of claim 20 wherein the adaptations comprise an adaptation that adjusts the duration of at least a portion of one of the stored prototype speech units.

28. The system of claim 20 wherein the adaptations comprise an adaptation that modifies the amplitude of at least a portion of one of the stored prototype speech units.

29. The system of claim 20 wherein the adaptations comprise an adaptation that time reverses at least a portion of one of the stored prototype speech units.

30. The system of claim 20 wherein the adaptations comprise an adaptation that uses a portion of one of the stored prototype speech units to realize a phoneme other than one realized in the original utterance from which the prototype was extracted.

31. The system of claim 20 wherein the source other than the target voice corpus comprises a shared corpus that includes speech units recorded from a different human speaker than the human speaker used to record the target voice corpus, and wherein the shared corpus is configured to be used in synthesizing multiple different target voices.

32. The system of claim 31 wherein the shared corpus further includes synthesized speech units.

33. The system of claim 31 wherein the shared corpus includes a plurality of prototype speech units, and the unit engine of the back end module is further configured to apply adaptations to selected ones of the prototype speech units of the shared corpus, to produce adapted speech units that are contextually appropriate for the utterance.

34. The system of claim 20 wherein the source other than the target voice corpus comprises a plurality of shared corpora that are each recorded from a different human speaker, and wherein each shared corpus is configured to be used in synthesizing multiple different target voices.

35. The system of claim 20 wherein the source other than the target voice corpus is a Rule-Based Speech Synthesizer configured to synthesize at least some speech units with Rule-Based Speech Synthesis (RBSS) rules.

36. The system of claim 20 wherein the target voice corpus further includes synthesized speech units.

37. A system for speech synthesis comprising:

a processor; and a storage medium having program instructions written thereon for execution on the processor, the program instructions including program instructions for:

a front end module configured to receive symbolic input descriptive of an utterance to be synthesized, a back end module configured to select one or more portions of the utterance to be constructed from certain Phone-and-Transition (P&T) speech units that function as prototype speech units, the prototype speech units obtained from a speech corpus, the speech corpus including speech units recorded from a human speaker, a unit engine of the back end module configured to apply Phone-and-Transition (P&T) adaptations to selected ones of the prototype speech units of the speech corpus that are derived from a context different than one in which they are to be used in the utterance, to produce adapted speech units that are contextually appropriate for the utterance, and a concatenation engine of the back end module configured to concatenate at least the adapted speech units from the speech corpus to produce a speech waveform for the utterance.

38. The system of claim 37 wherein the P&T speech units comprise one or more phones and transitions.

39. A method for speech synthesis comprising:

receiving symbolic input descriptive of an utterance to be synthesized;

selecting a portion of the utterance to be constructed from a speech unit of a speech corpus, the speech unit recorded from a human speaker, the speech unit lacking transitions at one or both of the speech unit's edges;

synthesizing a transition for use at an edge of the speech unit using Rule-Based Speech Synthesis (RBSS) rules; and concatenating the speech unit with the synthesized transition in producing a speech waveform for the utterance.

40. The method of claim 39 wherein the step of synthesizing further comprises:

obtaining one or more transition properties from the speech corpus for the transition to be synthesized.

41. The method of claim 40 wherein the one or more transition properties comprise at least one property selected from the group consisting of: formant frequencies, formant bandwidths, amplitudes, fundamental frequencies and voice quality characteristics.

42. The method of claim 39 wherein the RBSS rules are Rule Based Formant Synthesis (RBFS) rules.

43. The method of claim 39 wherein the speech unit of the speech corpus is a Phone-and-Transition (P&T) speech unit in which a beginning and an end of at least one phone or transition component have been labeled.

44. The method of claim 43 wherein the speech unit of the speech corpus is adapted by application of one or more P&T adaptations prior to the step of concatenating.

45. The method of claim 39 wherein the speech corpus is a target voice corpus recorded from a target speaker and configured to provide characteristics of a target voice.

46. The method of claim 39 wherein the speech corpus is a shared corpus, and wherein the shared corpus is configured to be used in synthesizing multiple different target voices.

47. The method of claim 39 wherein the step of concatenating further comprises:

concatenating the speech unit and the synthesized transition with one or more other speech units synthesized by RBSS rules.

48. The method of claim 39 wherein the step of synthesizing further comprises:

creating an extension segment at an edge of the synthesized transition, the extension segment to overlap another speech unit when the synthesized transition is concatenated.

49. A system for speech synthesis comprising:

a processor; and a storage medium having program instructions written thereon for execution on the processor, the program instructions including program instructions for:

a front end module configured to receive symbolic input descriptive of an utterance to be synthesized, a back end module configured to select a portion of the utterance to be constructed from a speech unit of a speech corpus, the speech unit recorded from a human speaker, the speech unit lacking transitions at one or both of the speech unit's edges, a synthesis module configured to synthesize a transition for use at an edge of the speech unit by use of Rule-Based Speech Synthesis (RBSS) rules, and a concatenation engine of the back end module configured to concatenate the speech unit with the synthesized transition in production of a speech waveform for the utterance.

50. The system of claim 49 wherein a synthesis module is further configured to obtain one or more transition properties from the speech corpus for the transition to be synthesized.

51. The system of claim 50 wherein the one or more transition properties comprise at least one property selected from the group consisting of: formant frequencies, formant bandwidths, amplitudes, fundamental frequencies and voice quality characteristics.

52. The system of claim 49 wherein the RBSS rules are Rule Based Formant Synthesis (RBFS) rules.

53. The system of claim 49 wherein the speech unit of the speech corpus is a Phone-and-Transition (P&T) speech unit in which a beginning and an end of at least one phone or transition component have been labeled.

54. The system of claim 53 wherein the speech unit of the speech corpus is adapted by application of one or more P&T adaptations prior to the step of concatenating.

55. The system of claim 49 wherein the speech corpus is a target voice corpus recorded from a target speaker and configured to provide characteristics of a target voice.

56. The system of claim 49 wherein the speech corpus is a shared corpus, and wherein the shared corpus is configured to be used in synthesizing multiple different target voices.

57. The system of claim 49 wherein the concatenation engine is further configured to concatenate the speech unit and the synthesized transition with one or more other speech units synthesized by RBSS rules.

58. The system of claim 49 wherein the synthesis module is further configured to create an extension segment at an edge of the synthesized transition, the extension segment to overlap another speech unit when the synthesized transition is concatenated.

* * * * *